United States Patent [19]

Coomer

[11] 4,305,212

[45] Dec. 15, 1981

[54] ORTHOTICALLY DYNAMIC FOOTWEAR

[76] Inventor: Sven O. Coomer, 1351 Parrott Dr., San Mateo, Calif. 94402

[21] Appl. No.: 940,569

[22] Filed: Sep. 8, 1978

[51] Int. Cl.[3] ..... A43B 21/36; A43B 13/20; A43B 13/38; A43B 23/08

[52] U.S. Cl. ..... 36/80; 36/29; 36/44; 36/69

[58] Field of Search ..... 36/25, 29, 43, 44, 69, 36/80, 129, 114, 92

[56] References Cited

U.S. PATENT DOCUMENTS

| | | | |
|---|---|---|---|
| 2,660,814 | 12/1953 | Ritchey | 36/80 |
| 2,680,919 | 6/1954 | Riggs | 36/80 |
| 3,922,801 | 12/1975 | Zente | 36/44 |

FOREIGN PATENT DOCUMENTS

| | | | |
|---|---|---|---|
| 1240066 | 7/1960 | France | 36/29 |
| 465940 | 5/1937 | United Kingdom | 36/80 |

*Primary Examiner*—Patrick D. Lawson
*Attorney, Agent, or Firm*—William H. Maxwell

[57] ABSTRACT

A shoe incorporating dynamic Orthotic means which adapt to the foot in a prescribed manner, controlling heel "strike" and weight bearing loads, establishing a cup-shape to "catch" the heel and foot to stabilize it, balancing and maintaining the sub-talar joint in a neutral attitude and the mid-tarsal joint locked, enabling the foot and ankle to maintain optimum integrity as an efficient support and propulsion system, and resisting the symptomatic tendency for the sub-talar joint and foot to overcompensate and overstress the anatomy.

22 Claims, 16 Drawing Figures

ORTHOTICALLY DYNAMIC FOOTWEAR

BACKGROUND

Conventional prior art shoes have been designed and constructed according to trends, with emphasis on cosmetic appearances rather than upon the bio-mechanical requirements of the anatomy involved. Heretofore, Orthotic control devices have been restricted to individual problems, but without an overall treatment of the many small but significant factors which are present within every individual's foot and having an effect upon his health and well being. That is, posture as it is effected by footwear has significant influence over pathologic difficulties with the anatomy, involving the bones, ligaments, cartilage, muscles, and general disposition of the internal organs. The problem lies in the sole of the shoe, including its attachment to the shoe upper, and tread design and frictional qualities thereof are not the answer. It is the basic foot-form or "last" which is of concern, to which linearly unyielding soles have been attached. And, since the sole controls the manner in which the entire shoe reacts to the usually hard unyielding ground surface, it is a general object of this invention to provide an Orthotically dynamic last and sole construction that compensates for ground surface hardness and irregularities while applying natural forces directly through the anatomy of the ankle processes.

The Orthopedist or Podiatrist works with many variables in specifying corrective control devices built specifically to control particular problems. However, it is the conventional shoe last and dynamic sole functions with which the expert must deal in his substitution of or insertion of corrective devices. For example, formed arch inlays superimposed upon a conventional linearly unyielding sole; this being a comforting factor but limited in the capacity of controlling the forceful leverages created continuously with every step. It is an object of this invention therefore, not to merely change existing last and sole design but to provide a new and improved last and sole which applies bio-mechanical effects as they compliment the anatomy through the ankle and leg processes.

The present invention involves the stabilizing of the ankle processes, it being a general object to do so, and particularly the sub-talar joint from which the calcaneus extends, and the mid-tarsal joint from which the remainder of the foot extends. With the present invention there is protection which inherently stabilizes the foot so as to protect against fatigue and so as to prevent violent pronation or supination otherwise likely to cause stress and/or injury. As used herein: pronation is "a flattening of the long arch (medial arch) or a motion which everts the sole (plantar aspect) of the foot", and supination is "a motion of the foot which inverts the sole thereof" or "to turn the foot inwardly".

The dynamics of a gait or stride cycle varies from person to person, but invariably involves the "strike" of the foot with the ground support or playing surface, the "slap" of the heel as the sole flattens at the heel, the "pronation" as the plantar surface of the foot faces the playing surface for support, and supination as the foot moves towards propulsion and "toe-off" and leaves the playing surface. Accordingly, it is an object of this invention to accommodate the aforesaid dynamic functions by catching the heel at the strike and to stabilize the foot processes throughout the following dynamic functions of slap, pronation, supination and toe-off.

More specifically, the foot processes are stabilized or balanced by a neutral sub-talar joint and a locked mid-tarsal joint in a cup of the dynamic last or sole. In practice, the sole has a calculated amount of distortion patterned so as to react under pressure and to yield to the force of the strike and to absorb the impact of the slap. Said distortion increases proportionately with increased loadings.

The material of which a shoe is made, particularly the sole, not only determines the shape but also the action thereof—stiffness or flexibility. It is an object of this invention to not only select materials conducive to the function provided for but also to fabricate the materials in a manner to enhance and/or supply the bio-mechanical functions herein prescribed. To these ends therefore, there is provided an elastomeric solid or the like using a system of varied thicknesses for resilience and the establishment of beam and rib support; or a system of non-interconnected and interconnected gas filled cells, as for example by using layers of flexible material selectively joined and bonded together so as to check the flow of gases captured thereby and so as to control the distortion related to both cushioning and flexibility.

TECHNICAL ANALOGIES for an understanding of the concepts herein disclosed are as follows:

The reason for a shoe, or sole, is to protect the foot from the various playing surfaces and to give the best possible traction and friction qualities between the foot and said surface; as by using a variety of materials, sole tread patterns, spikes, cleats and so on. For example, a shoe is not necessary at all, for even the most aggressive activity, when the playing surface is loose soft sand. The finer and firmer the sand becomes, until eventually hard as concrete (see FIG. 4), the greater the need for compensating systems that the individual must attach to the feet to protect and isolate the feet from the playing surface. When the playing surface is loose soft sand, the lower ankle or sub-talar joint and mid-tarsal joint, or transverse tarsal joints, of a stable foot, can maintain their braced neutral attitude and structural integrity, and the strike or impact forces are dispersed directly through a "locked and rigid" foot and into the sand long enough for the muscles to balance and brace the ankle processes. In other words, the soft sand allows an individual to easily control and maintain both the rearfoot and forefoot stability perpendicular to the forces transmitted through the tibial shaft. This is because the sand acts as a natural shock absorber distributing the strike loadings of each stride over a long time period so that the foot has time to be balanced by supporting muscle contractions while the shock loadings are dissipated into the sand. The individual can also maintain the pre-strike attitude of the sub-talar joint in neutral and the mid-tarsal joint locked throughout the entire gait phase. Thus, the foot remains a balanced and rigid lever for stability and propulsion. With the sub-talar joint neutral and the mid-tarsal joint locked the loadings are transmitted directly through the foot without being lost in an otherwise very complex system of collapsing bones and compensatory motions. In this way the participant can support much higher loadings, because the foundation is more stable and a mechanically efficient structure, the participant being better balanced with much less risk of injury and provided with a much higher performance capability.

As the sand becomes harder, until eventually as hard as concrete, more of the strike forces have to be absorbed and compensated for. The sub-talar (ankle) system is not always strong enough to resist an impact loading of reduced time duration, in which case it may not be possible to bear forces evenly throughout the foot or inside edge of the foot overloaded and unbalanced and subject to severe supination or pronation. Therefore, this shoe is provided so that the strike forces are transmitted as directly as possible to the playing surface, through a neutral sub-talar joint and a locked or muscularly well supported mid-tarsal joint, with an energy absorbing system that varies beneath the different plantar portions of the foot. In other words, this shoe is a dynamic Orthotic device that adapts to the foot in a carefully controlled manner, at the moment of strike when the weight bearing loads are the greatest, creating a "catch" or cupping shape to capture the heel and stabilize it, blocking any tendency for the sub-talar joint to move out of neutral or the mid-tarsal joint to unlock, this shoe stabilizing the lower ankle and foot in neutral, balancing the foot against typical pronation, and controlling the carriage of weight throughout every phase of gait from standing to running and jumping.

Concerning the heel aspects of the shoe, the strain loadings can be very high and of short duration during strike contact, at which moment shock absorption and the dissipation of force is most important. It is the time when the foot articulation processes is most susceptible to being overloaded, tending to slip or distort and causing pronation in most people, limiting their performance potential and comfort. The purpose of this shoe is to capture or "catch" the heel at neutral, just as it is the moment before strike contact, by yielding in such a way as to hold the ankle and foot system at neutral and locked until the stress loadings have been dissipated. The physical properties of the materials determines the exact profiles and configuration of the sole with respect to the calcaneus, as will be described. For example, a material having a determined slow rate of memory can be employed, so that after each strike the shoe will be slowly released at a predetermined rate from its distorted configuration and act as an Orthotic device through dynamic weight bearing, there being a limit to such distortion so that the sub-talar joint and mid-tarsal joint will remain stabilized. Accordingly, the shoe distorts to absorb the strike forces with every landing, and when the forces dissipate the heel cup returns to neutral, supporting the heel weight in a springy fashion throughout the remainder of the gait cycle, or while the individual is standing. In this way the shoe is totally dynamic, always adapting to the weight loadings which are directly related to the tendency for the feet to distort or pronate.

The following percentage sequence of the gait cycle is shown in FIG. 3 of the drawings, the basic functions of the shoe heel being as follows:

At 0% just before strike the sub-talar joint is neutral, the mid-tarsal joint is locked, and both are braced and ready to absorb the impact.

At 10% just after the strike the heel catching mechanism distorts in a predetermined manner to catch or cup the heel and to hold the sub-talar system neutral and locked, while at the same time tempering or dissipating the stresses of impact. Note that this first heel contact is typical of a walking gait, and that this "catch" function of the shoe also applies in running when the strike is first made on the forefoot followed by impact applied to the heel.

At 25% the lively action of the heel cup tempers and dissipates the impact and loading forces much like a spring while the forefoot plantar surfaces begin making contact with the ground.

At 50% the entire plantar portion of the foot is in contact with the ground as the weight moves forward about midfoot. The heel of the shoe remains active in tempering the weight of the individual and forces him from the ground, while the other parts of the shoe are performing their controlling functions. At this point the shoe functions are as if the individual were to strike at midfoot, or forefoot or to be simply standing.

At 95% the plantar surface of the shoe is raised and readied for toe-off. It is important to note that throughout the whole gait cycle the sub-talar system has remained neutral.

This shoe has little or no distortion while standing, depending for example upon the weight being borne by the shoe and how the individual bears weight between the feet, i.e. more weight upon one foot than the other, weight of the individual being a variable that is coordinated with the flex modulus of the materials used and complemented by the sole configuration.

As shown in FIG. 7, "slap" is very apt to occur in ordinary shoes right after heel strike which often initiates a very powerful lever system that tends to flatten the sole onto the usually hard and flat playing surface with a violent slapping action. This slap is a stress that is transferred directly to the anatomy, wrenching and tending to dislocate the original braced and neutral posture of the foot before strike. It is often a stress too great for the anatomy to resist, and is transferred from pronation to tibial rotations, hips and on through the remainder of the anatomy. Dislocations therefrom result in a hypermobility of the foot throughout the whole gait phase, also creating an inefficient lever system for the foot to propel from, and the excessive motion and mobility accelerates fatigue and inefficiency in the transmission of forces between the individual and the surface.

SUMMARY OF INVENTION

This invention relates to the minimumization of the excessive mobility and instability characteristic in the vast majority of feet within the ankle processes and throughout the gait cycle between strike and toe-off or propulsion, inclusive of the standing posture. These instabilities are anatomical in nature and are caused by any number of pathological, genetic or environmental influences, and particularly by shoe designs. Accordingly, the Orthotically dynamic sole of the present invention serves a number of purposes as follows:

(1) To have a dynamically functional Orthotics controlling system or device that stabilizes the ankle and foot processes, and that resists the tendency of pronation.

(2) To have a dynamic shock absorbing system under the foot, built into the sole, and to distribute the stress loadings over longer time periods thereby reducing physical stress and fatigue.

(3) To control the manner in which an individual bears and balances weight through each phase of his gait, between strike and toe-off or propulsion, and so that optimum balance, anatomical integrity, correct posture and altertness is encouraged.

(4) To present a stable platform under the foot to resist the tendency for the ankle processes to dislocate, as may be caused by a gradual, repeated or even violent twisting resulting in stress fractures, shin splints, twisted joints, and so on.

(5) This sole is adaptable to additional customizing Orthotic attachments to accommodate specific individual variables such as forefoot or rearfoot varus or valgus, or calcaneal pitch etc. This can be done with reinforcement studs or by reshaping the parts of the sole.

(6) This sole is a restrictive stabilizing and shock absorbing device, incorporating a minimum of intermediary materials while protecting the foot from the ground support or playing surfaces. The sole is attached to the foot by means of an upper designed to resist the tendency for the foot to twist or move uncontrollably independent of the shoe, said twisting inside the shoe being typical of ordinary shoes and noticeable in a loss of energy and efficiency between the foot and shoe, and all of which is an instigator of potential injury, blisters and other discomforts, not to mention the loss of potential performance, whether that be standing for extensive periods of time or in carrying out athletic activities.

(7) The improved shoe of the present invention provides means by which the strike forces are transmitted as directly as possible to and from the playing surface, through a neutral sub-talar joint and a locked and properly balanced mid-tarsal joint.

In view of the foregoing it will become apparent that this shoe is energy absorbing and has functional variations respective to each aspect of the foot and its support controlling the integrity of the sub-taler and mid-tarsal joints, all of which is the key to controlling the whole anatomical integrity of the foot and hence the body posture and functions.

DRAWINGS

The various objects and features of this invention will be fully understood from the following detailed description of the typical preferred forms and applications thereof, throughout which description reference is made to the accompanying drawings, in which.

Figure 16:
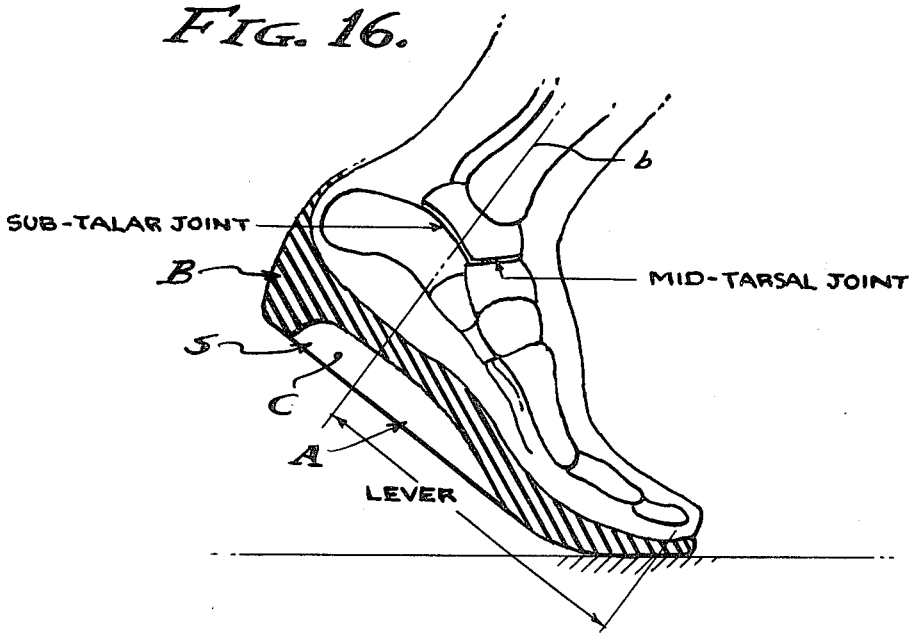

And FIG. 16 is an illustration of the foot anatomy dynamically applied to the orthotic shoe hereinafter described.

PREFERRED EMBODIMENT

This invention relates to footwear that is totally dynamic, adapting continuously to the force loadings which are directly proportionate to the tendency for the feet to distort, dislocate or pronate; in other words, it is the footwear that distorts under the same force loadings that would otherwise distort and/or dislocate the anatomy of the foot. Accordingly, the footwear is in the nature of a shoe to be fitted to an individual's foot, the shoe being comprised of, generally, a sole S that underlies the plantar surface of the foot, and an upper U that extends from the sole to enclose the forefoot while exposing the ankle. The sole S is an elongated member made of flexible and depressible material that is resilient, and adapted to be distorted by force and to return to its original form at a predetermind rate. The upper U is provided for holding the sole S securely and comfortably to the foot, and is essentially a radial wrapping that embraces the sole S and individual's foot as one, preferably joined with the sole to be integral therewith. The upper U embraces a substantial part of the foot from toe to heel thereof for protection from external elements.

The elongated sole S in one form is made of a flexible and resiliently depressible elastomer or a substitute for or of rubber, and comprised of a toe portion 10, a ball portion 11, an arch portion 12, and a heel portion 13. These portions are integrally formed and/or molded as one body to underlie the plantar portion of the individual's foot to which they are correspondingly complementary. That is, said corresponding portions of the sole and of the individual's foot are therefore coextensive so as to have interface engagement, respectively. As shown, the sole is form fitted to the individual's feet, right and left, so as to accommodate the forefoot X, arch Y and heel Z in each instance.

The upper U can vary in style and by choice of materials, and is a supple cover of leather or woven textile material form fitted to the contoured last configuration of the individual's foot, to cover the toe, ball and arch portion and to wrap around the heel of the foot in conformity to the foot configuration. As shown, the upper U is permanently secured to the sole S to extend upwardly from the periphery thereof where it is secured and attached by suitable and conventional means. It is significant as will be seen from the drawings that the curvatures of the foot supporting surface of the sole S are continued as fair lines into the interior contoured curvatures of the said upper. It is to be understood that the upper U is reinforced and held to the shape of the foot, especially around the heel, so as to remain tightly secured thereon and held thereto as by lacings 14. As shown for example, double lacing is employed extending coextensively over the arch of the foot and to the toe portion thereof overlying the ball portion 11 of the sole S. The upper U is flexible so as to bend and turn with the sole S and in practice is tightly adhered to the anatomy of the foot dependent upon the tightness of the lacings 14.

Figure 1:
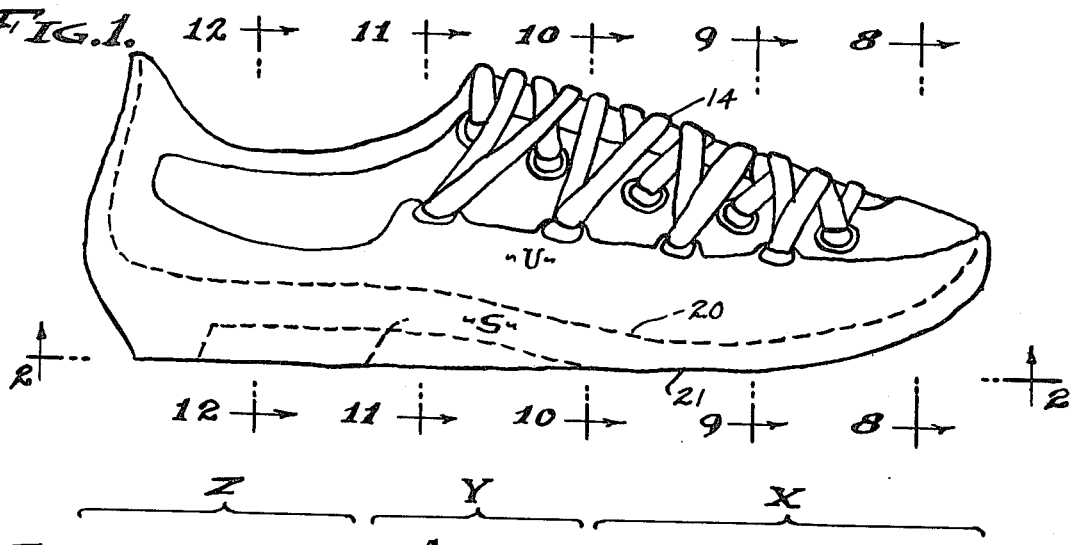
FIG. 1 is a side elevation of a shoe incorporating the features of the present invention.
Figure 2:
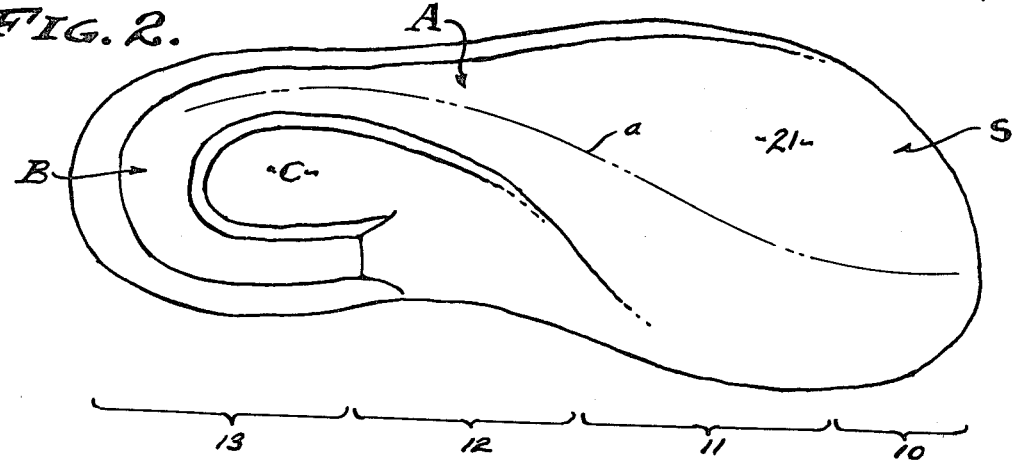
FIG. 2 is a bottom view taken as indicated by line 2—2 on FIG. 1.
Figure 3:
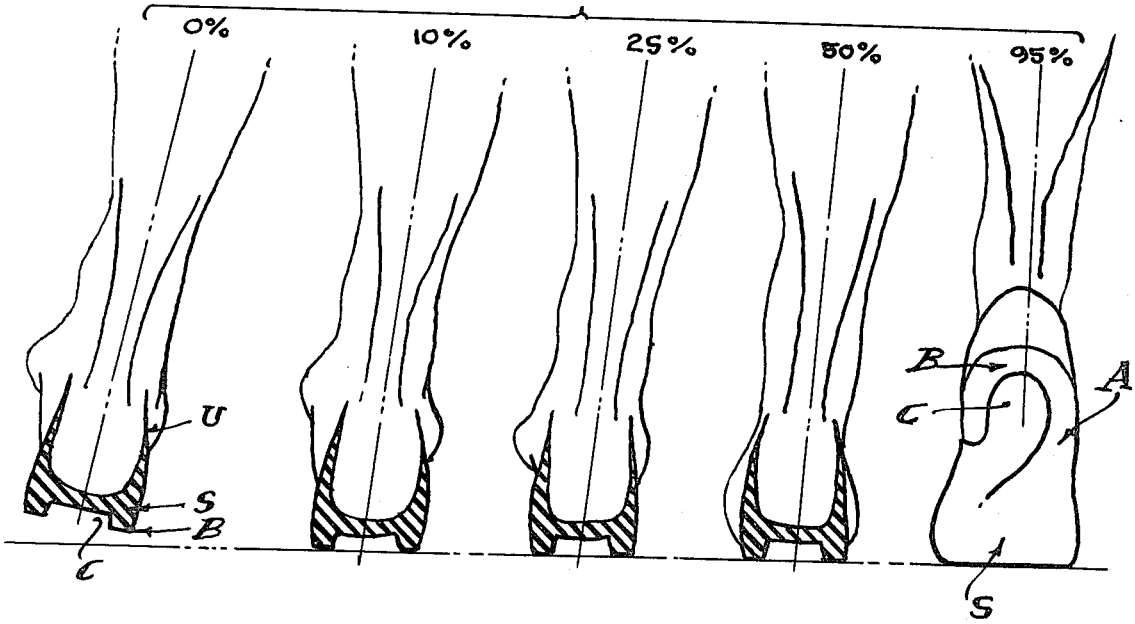
FIG. 3 is a composite of views illustrating the percentage functions of the shoe heel.
Figure 4:
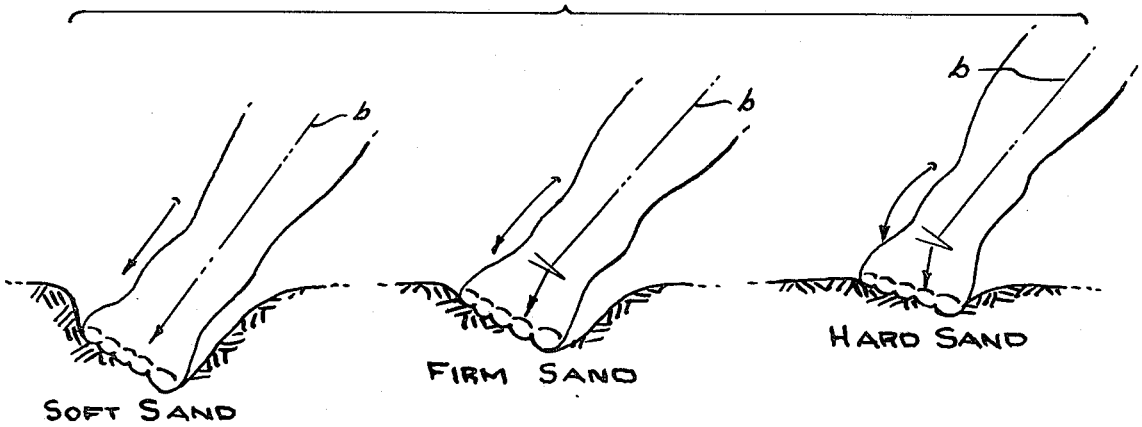
FIG. 4 is a composite of views illustrating the dynamic action of a person's foot applied to varied hardnesses of sand.
Figure 5:
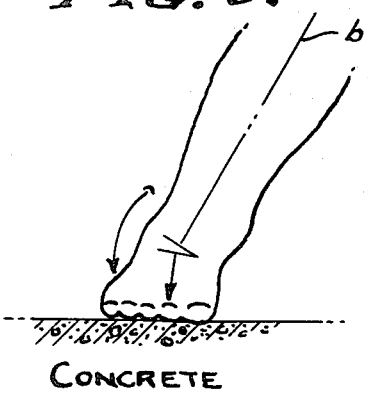
FIG. 5 is a view similar to those of FIG. 4 illustrating the dynamic action of a person's foot applied to concrete.
Figure 6:
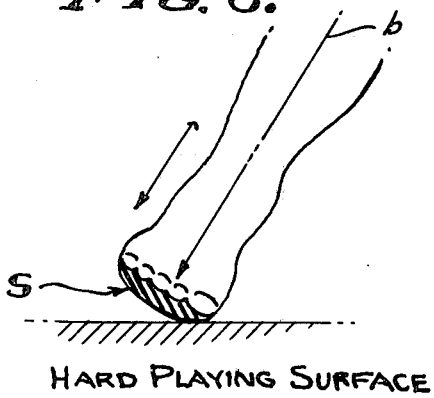
FIG. 6 is a view similar to those of FIGS. 4 and 5 illustrating the dynamic action of a person's foot and sole of the present invention applied to a hard playing surface.
Figure 7:
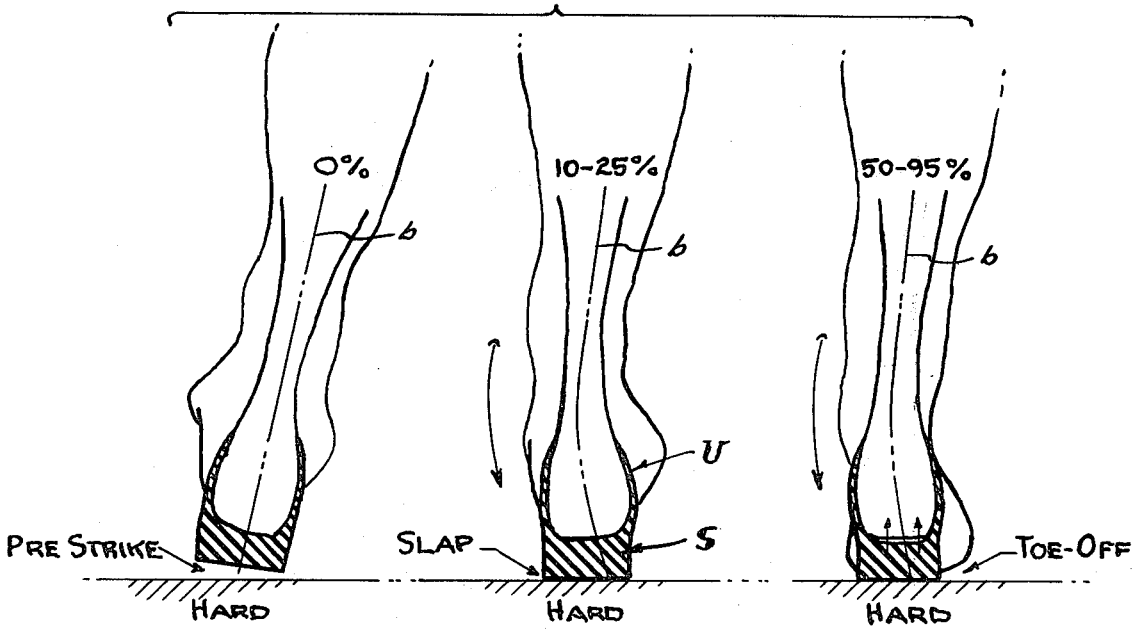
FIG. 7 is a composite of views illustrating the percentage functions of a person's gait as related to prestrike, slap and toe-off.

In accordance with this invention, the plantar surface is provided with the unique configuration shown in FIG. 2, wherein a longitudinally disposed rib A extends from the toe portion 10 to the heel portion 13, and wherein a circumferentially disposed rib B extends around said heel portion 13, and all of which establishes an instep cavity C underlying the arch portion 12 and a substantial part of the heel portion 13. The ribs A and B continue one into the other as they depend from the sole body, being formed integral therewith. As shown, the sole S per se has a nominal thickness of about $\frac{1}{8}$ its maximum width, and from which the ribs A and B depend in a wedge formation increasing in depth as they extend toward the heel extremity of the sole. The ribs A and B are characteristically narrow at the arch and heel portions of the sole, spreading and flattening gradually into the ball and toe portions thereof. In practice, the rib A is integrated with the toe portion 10, so as to be indistinguishable thereat; becoming of identifiable dimension at the ball portion 11 (compare FIGS. 8 and 10). Accordingly, the rib A increases in height as it extends rearward (see FIG. 11) to merge with rib B at the outside of the sole, the median line a of the rib A being diagonally disposed and preferably curvilinear so as to underlie the median line of the mid-foot, for proper carriage as it extends to the fore-foot. The rib B is of substantially uniform height as it extends peripherally around the heel portion 13 in semi-circular form, or U-shaped, preferably stopping short of the arch portion 12 at the inside of the sole. Characteristically therefore, the cavity C extends forwardly from the heel to open inwardly at the arch portion 12. As indicated, the continuous plantar surfaces of the ribs A and B are coplanar, except where they are to be modified as hereinafter described. It is to be understood that the rib B can continue across the instep to merge with the sole, if so desired, without affecting the above described relationship of ribs A and B.

Figure 8:
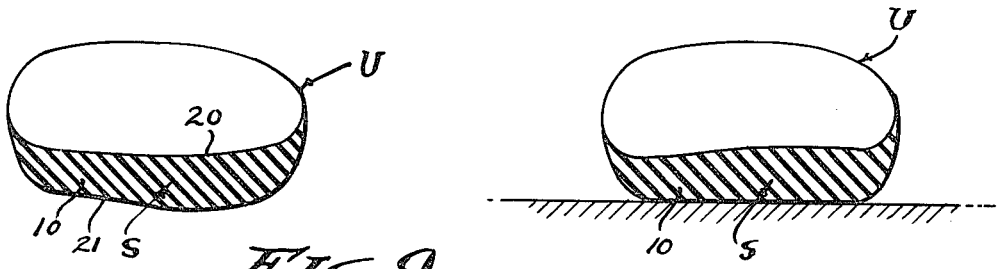
FIGS. 8, 9, 10, 11 and 12 are each a composite of views illustrating the unweighted and weighted conditions of the shoe at their section lines taken on FIG. 1 respectively.

Referring now to FIG. 8 and the toe portion of the forefoot X of the sole S, both unweighted and weighted conditions of the sole are shown. For example, the upper foot supporting surface 20 of the sole S is substantially concaved and curved upwardly at each side so as to fair into the shoe upper U, and further, the lower plantar surface 21 of the sole S is substantially concaved beneath the large toe when unweighted; so as to provide a concavity for said toe when weighted, creating a footprint like pattern beneath that feature of the individual's foot to cradle the same. This change in cross sectional shoe formation simulates running in sand or the like, so that the foot is less likely to dislocate and become hyper mobile.

Figure 9:
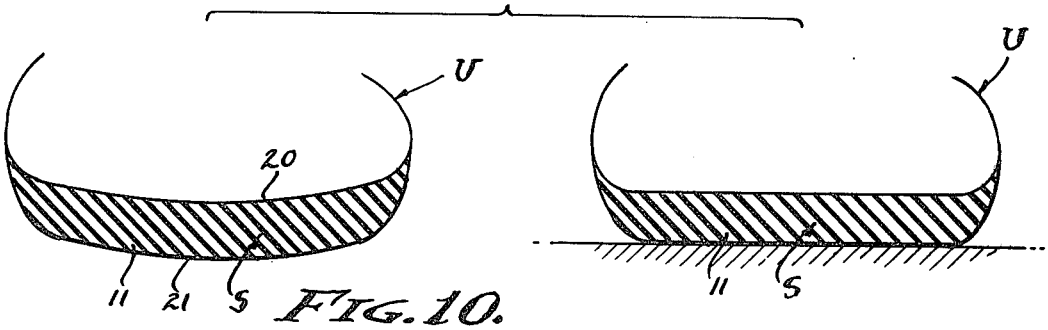

Referring now to FIG. 9, and the ball portion of the forefoot X of the sole S, both an unweighted and weighted condition of the sole is shown. For example, the upper foot supporting surface 20 of the sole S is substantially concaved when unweighted and curved upwardly at each side so as to fair into the shoe upper U; and further, the lower plantar surface 21 of the sole S is substantially convex when unweighted and curved upwardly at each side so as to fair into the shoe upper U; so as to provide parallelism between surfaces 20 and 21 when weighted, create a normally flat platform beneath the transverse ball portion of the individual's foot to cradle the same. This change in cross sectional shoe formation simulates running in sand or the like, so that the foot is less likely to dislocate and become hyper mobile.

Figure 10:
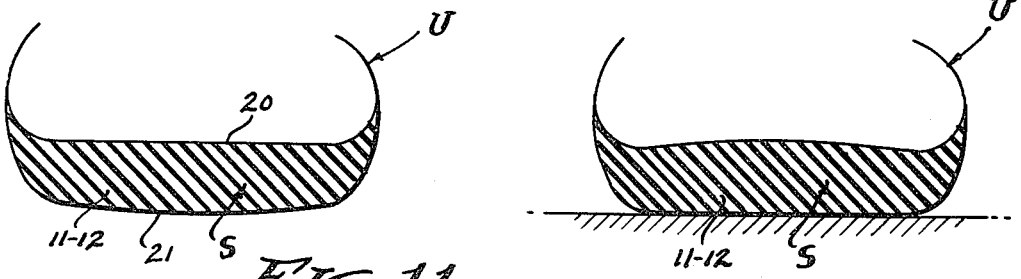

Referring now to FIG. 10 and the transition from the ball portion to the arch portion of the sole S, both unweighted and weighted condition of the sole is shown. For example, the upper foot supporting surface 20 of the sole S is substantially convex when unweighted, and curved upwardly at each side so as to fair into the shoe upper U; and further, the lower plantar surface 21 of the sole S is substantially convex when unweighted and curved upwardly at each side so as to fair into the shoe upper U; and so as to provide a raised arch support when weighted, creating a transverse inclined platform beneath the instep or arch portion Y of the individual's foot to cradle the same. This change in cross sectional shoe formation simulates running in sand or the like, so that the foot is not likely to dislocate and become hyper mobile.

Figure 11:
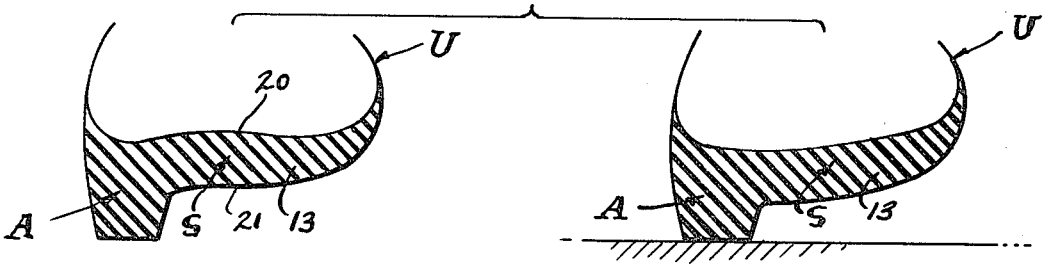

Referring now to FIG. 11 and the arch portion Y of the sole S, both an unweighted and weighted condition of the sole is shown. For example, the upper foot supporting surface 20 of the sole S is transversely recurved when unweighted, between its outside convex margin and inner concaved margin, and curved upwardly at each side so as to fair into the shoe upper U; and further, the lower plantar surface 21 of the sole S is transversely recurved between the inside of rib A and inside of the sole S when unweighted, and curved upwardly at the instep so as to fair into the shoe upper U; so as to provide a raised arch supported between the rib A and/or spaced sections of rib B when weighted or unweighted, creating a transversely inclined platform beneath the instep (forward of the heel X) of the individual's foot to cradle the same. There is a controlled change in cross sectional shoe formation as the ribs A and B deform to simulate running in sand or the like, so that the foot is not likely to dislocate and become hyper mobile.

Figure 12:
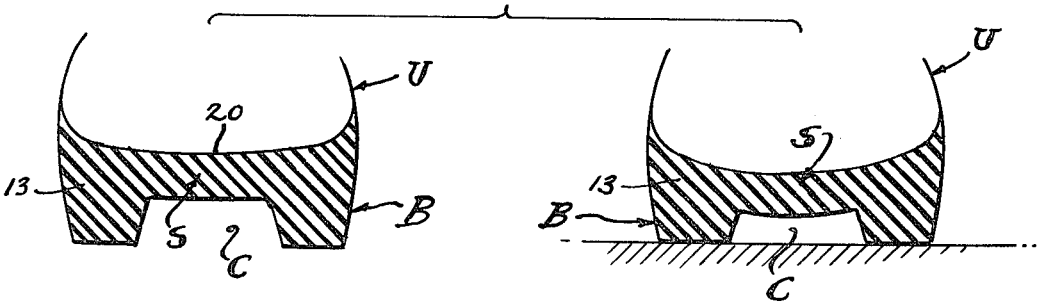

Referring now to FIG. 12 and the heel portion Z of the sole S, both an unweighted and weighted condition of the sole is shown. For example, the upper foot supporting surface 20 of the sole S is concaved and curved upwardly at each side so as to fair into the shoe upper U; and further this portion of the sole is of substantial thickness for controlled flexibility as it extends transversely between the opposite side portions of rib B, creating a cupped platform beneath the heel Z of the individuals foot to catch and cradle the same. There is restrictive but nevertheless controlled change in cross sectional shoe formation as the rib B deforms to simulate running in sand or the like, and wherein the said heel portion Z in the weighted condition has a slightly concaved upper surface supported by the rib B.

The sole configuration hereinabove described is made of a flexible and compressible material such as, for example, a rubber-like elastomer the resilience and hardness of which is determined as circumstances require so as to functionally control the aforesaid configuration changes. That is, the material as related to thickness of the sole formation determines flexibility and compressibility or softness thereof which permits the distortions which establish the various degrees of departure from original form in the simulation of running in sand or like, thereby applying a very natural alignment of forces along the tibial axis b and through the neutral sub-talar joint and locked mid-tarsal joint.

Figure 13:
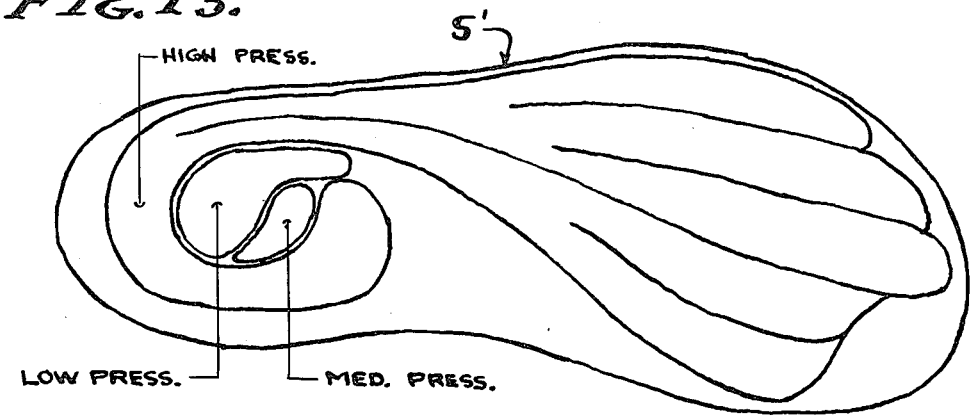
FIG. 13 is a view similar to FIG. 2 diagramming the gas filled cells of a second form of sole.
Figure 14:
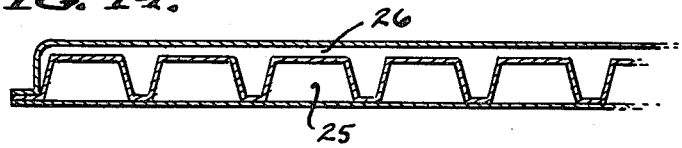
FIGS. 14 and 15 are enlarged detailed sectional views showing the construction of cells and passageways employed in the sole of FIG. 13.
Figure 15:
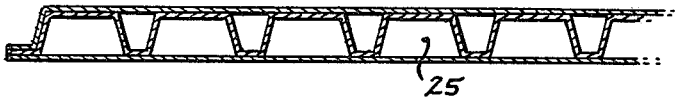

In accordance with this invention, the desired Orthotically dynamic function of the sole S′ can be provided with a system of nervatures at controlled gas pressures (see FIG. 13). Some gases are free to move along the sole S, and others are contained within cells, so as to create the desired controlling effects. The gas pressures are of course carefully selected, and the surface of the sole can be flat. This gas distribution system creates a very functional shock absorbing system, and other advantages such as insulation, breathability (by expansion and contraction), and design patterns for customizing flexibility to the individual. By welding or fusing two imperforate air tight plastic sheets in a variety of patterns, a large variety of effects can be obtained for Orthotics control, a typical pattern being shown in FIG. 13. By spacing the welds close together for firm support, the material between the welds has less tendency to expand and adapt. Long welds for stiffness will restrict the inflated material from adapting and thereby give the designer linear control or flexibility. By using a plurality of sheets, as shown in FIGS. 14 and 15, such as three layers of plastic, one type of gas is for example sealed by means of two sheets under a specified pressure in cells 25 so that the gas cannot move. A third layer of plastic superimposed upon the cells 25 establishes channels 26 controlling the flow of another gas and pressure thereof that is free to flow dynamically under the individual's applied weight. The supporting effect of the bubbles and channels is regulated by their size, gas volume and pressure, and with the ultimate control determined by three dimensional fabrication for use in both shoe sole and upper applications as well as for use in boot linings. One particularly useful application is an Orthotically Dynamic Lining for various kinds of boots, used for example for skiing, hiking, motor cross, snow-mobiling, and for lumberjack work boots etc.

The shoe upper U is necessary for holding the sole S (S') securely and comfortably to the foot, and is very important for the optimum function of the shoe. Short of actually cementing the sole to the foot, the upper is preferably wrapped onto the sole and applied as a whole to the individual's foot. That is the sole S (S') and the upper U become an integral unitary system, the upper protecting and insulating the foot from the various external elements. The lacings 14 effectively wrap the sole S (S') to the foot by drawing the walls of upper U which tangentially fair into either the upper sole surface 20 or plantar surface 21, thereby establishing an effective latitude of pull as deformation takes place.

The propulsive effect of the sole is now to be considered, the lever effect of the individual's toes being insufficient in many cases and which greatly reduces the propulsion potential, in many cases because the toes are simply not strong enough to provide the necessary lever without some mechanical support. That is, dorsiflextion across the ball portion 11 (first metatarsal head) causes strain and early fatigue; a problem that is resolved with the present invention by the projection of rocker applied to the longitudinal formation of the toe portion 10 and ball 11 (see FIG. 16), and all of which can be combined with stiffeners and/or with the built-in flexibility of the materials used in construction. Essentially, the sole S in the area of portions 10 and 11 is semi-rigid and acts as a cam from mid-gait to toe off, thus affording a smooth and efficient transmission of propulsion energy. As shown, the effective propulsion lever is increased by the rocker cam action of the sole S, maximized at the toe off position.

From the foregoing it will be seen that I have provided an orthotic footwear that stimulates the natural conditions of walking or running upon soft earth or sand. It is to be understood, ideally:

Just before strike contact, the sub-talar joint is neutral, the mid-tarsal joint is locked, and the whole foot is braced and ready to absorb the forces of impact. Just after strike the rib B distorts in a predetermined manner to "catch" the heel, and heel cup C holds the sub-talar joint and mid-tarsal joint neutral and locked. The sole dissipates or tempers the stresses of impact, which makes it possible for the sub-talar joint and mid-tarsal joint to maintain their predisposed integrity without being wrenched out of position by the forces of the strike. This simulates and is not unlike the dissipating action of soft surfaces such as grass, soft ground or sand. As the forefoot begins contact . . . the heel cup C continues dissipating the loading forces much like a spring. The mid- and forefoot cross sections of the sole begin their tempering and balancing functions, directing or guiding the application of forces along the recurved median line a throughout the gait from heel to toe. If the individual were to strike at any intermediate point along the sole, the function would remain substantially the same, and which also applies to balance while standing. It is significant that throughout the entire gait cycle the sub-talar system remains neutral, and that the transfer of forces into the tibial shaft carries directly through the locked mid-tarsal joint with minimal side loading or stresses. The sole is responsive to applied weight, static or dynamic and will adapt continuously to the needs of the individual applying force thereto.

Having described only typical preferred forms and applications of my invention, I do not wish to be limited or restricted to the specific details herein set forth, but wish to reserve to myself any modifications or variations that may appear to those skilled in the art as set forth within the limits of the following claims:

I claim:

1. Orthotically dynamic footwear that adapts to force loadings which are directly proportionate to the tendencies for a person's foot to distort, and including; a sole of flexible and resiliently depressible material complimentary to and underlying the plantar surface of the persons foot, an upper of flexible material continuing from the perimeter of the sole and fittedly embracing the heel to forefoot of the persons foot, the ground engaging plantar surface of the sole having a depending rib of increased depth extending from the toe portion of the sole to the outside of the heel portion thereof and continuing peripherally around the heel establishing an underlying cavity.

2. The orthotically dynamic footwear as set forth in claim 1, wherein the said depending rib is integrated with a toe portion of the sole to be indistinguishable thereat.

3. The orthotically dynamic footwear as set forth in claim 1, wherein the said rib follows a diagonally curvilinear median line at the midfoot, as it extends from a toe portion to the said outside thereof.

4. The orthotically dynamic footwear as set forth in claim 1, wherein the continuing heel portion of the said depending rib stops short of the arch at the instep side of the sole.

5. The orthotically dynamic footwear as set forth in claim 1, wherein the said depending rib is integrated with a toe portion of the sole to be indistinguishable thereat, and wherein the said rib follows a diagonally curvilinear median line at the midfoot as it extends from a toe portion to the said outside thereof.

6. The orthotically dynamic footwear as set forth in claim 1, wherein the said depending rib is integrated with a toe portion of the sole to be indistinguishable thereat, and wherein the continuing heel portion of the said rib stops short of the arch at the instep side of the sole.

7. The orthotically dynamic footwear as set forth in claim 1, wherein the said depending rib is integrated with a toe portion of the sole to be indistinguishable thereat, wherein the said rib follows a diagonally curvilinear median line at the midfoot as it extends from a toe portion to the said outside thereof, and wherein the continuing heel portion of the said rib stops short of the arch at the instep side of the sole.

8. The orthotically dynamic footwear as set forth in claim 1, wherein the said depending rib is substantially one fourth the width of the sole throughout the heel and arch and of increased width throughout the midfoot merging with a toe portion of the sole to be indistinguishable thereat.

9. The orthotically dynamic footwear as set forth in claim 1, wherein the said depending rib is of substantial height throughout the heel and arch and tapered in height throughout the midfoot merging indistinguishably into a toe portion of the sole.

10. The orthotically dynamic footwear as set forth in claim 1, wherein the said depending rib is of substantial height and substantially one fourth the width of the sole throughout the heel and arch and tapered in height and of increased width throughout the midfoot merging indistinguishably into a top portion of the sole.

11. Orthotically dynamic footwear that conforms to a person's foot configuration while adapting to force loadings which are directly proportionate to the tendencies for the foot to distort, and including: a sole of flexible and resiliently depressible material having an unweighted formed condition complementary to and underlying the plantar surface of the person's foot, an upper of flexible material continuing from the perimeter of the sole and fittedly embracing the heel to forefoot of the person's foot, the ground engaging plantar surface of the sole having a depending rib of increased depth extending from the toe portion of the sole to the outside of the heel portion thereof and continuing peripherally around the heel establishing an underlying cavity, said sole having a weighted deformed condition adapting to force loadings applied by the pressure of the person's foot in opposition to a supporting surface engageable with the plantar surface of the sole.

12. The orthotically dynamic conforming footwear as set forth in claim 11, wherein the toe portion of the sole in the unweighted condition has a transversely concaved upper surface for foot support and a generally convex lower surface with a transversely concaved portion beneath the large toe of the person's foot, and wherein the said toe portion in the weighted condition has transversely flattened upper and lower surfaces with a transversely concaved portion of the upper surface beneath the large toe.

13. The orthotically dynamic conforming footwear as set forth in claim 11, wherein the ball portion of the sole in the unweighted condition has transversely concaved and convexed upper and lower surfaces respectively, and wherein the said ball portion in the weighted condition has substantially straight and parallel upper and lower surfaces respectively.

14. The orthotically dynamic conforming footwear as set forth in claim 11, wherein the transition portion from the ball portion to the arch portion of the sole in the unweighted condition has a transversely flat upper surface for foot support, and a transversely convex lower surface for supporting surface engagement, and wherein the transition portion in the weighted condition has a transversely convex upper surface and a transversely flat lower surface.

15. The orthotically dynamic conforming footwear as set forth in claim 11, wherein the arch portion of the sole in the unweighted condition has a transversely convexed and inwardly inclined upper surface for foot arch support, and a generally concaved lower surface extending from the rib to underlie the instep of the foot, and wherein the said arch portion in the weighted condition has a substantially flattened upper surface and parallel lower surface inclined toward the instep.

16. The orthotically dynamic conforming footwear as set forth in claim 11, wherein the heel portion of the sole in the unweighted condition has a transversely concaved upper surface for heel support by means of the depending peripheral rib with the cavity beneath the lower surface of said heel portion, and wherein the said heel portion in the weighted condition has a slightly flattened upper surface supported by a depressed peripheral rib.

17. The orthotically dynamic conforming footwear as set forth in claim 11, wherein the toe portion of the sole in the unweighted condition has a transversely concaved upper surface for foot support curved upwardly at each side to fair into the upper interior and a generally convex lower surface with a transversely concaved portion beneath the large toe of the person's foot, and wherein the said toe portion in the weighted condition has transversely flattened upper and lower surfaces with a transversely concaved portion of the upper surface beneath the large toe.

18. The orthotically dynamic conforming footwear as set forth in claim 11, wherein the transition portion from the ball portion to the arch portion of the sole in the unweighted condition has a transversely flat upper surface for foot support curved upwardly at each side to fair into the upper interior and a transversely convex lower surface for supporting surface engagement, and wherein the transition portion in the weighted condition has a transversely convex upper surface and a transversely flat lower surface.

19. The orthotically dynamic conforming footwear as set forth in claim 11, wherein the arch portion of the sole in the unweighted condition has a transversely convexed and inwardly inclined upper surface for foot arch support curved upwardly at each side to fair into the upper interior and a generally concaved lower surface extending from the rib to underlie the instep of the foot, and wherein the said arch portion in the weighted condition has a substantially flattened upper surface and parallel lower surface inclined toward the instep.

20. The orthotically dynamic conforming footwear as set forth in claim 11, wherein the heel portion of the sole in the unweighted condition has a transversely concaved upper surface for heel support curved upwardly at each side to fair into the upper interior and defining a cup embracing the person's heel and supported by means of the depending peripheral rib with the cavity beneath the lower surface of said heel portion, and wherein the said heel portion in the weighted condition has a slightly flattened upper surface supported by a depressed peripheral rib.

21. Orthotically dynamic footwear that pneumatically adapts to force loadings which are directly proportionate to the tendencies for a person's foot to distort, and including; a sole of flexible material formed into a multiplicity of nervatures by first and second layers of flexible material welded together to form gas tight cells of the sole and by a third layer of flexible material overlying the cells of the first and second layers thereof forming gas transfer channels therebetween to control gas pressures complementary to and underlying the plantar surface of the person's foot, and an upper of flexible material continuing from the perimeter of the sole and fittedly embracing the heel of the person's foot.

22. The orthotically dynamic pneumatic footwear as set forth in claim 21, wherein said nervatures comprising restriction means controlling the flow of gas between the gas tight cells.

* * * * *